US006409885B1

(12) United States Patent
Smit et al.

(10) Patent No.: US 6,409,885 B1
(45) Date of Patent: Jun. 25, 2002

(54) PULP FORMING MACHINES

(75) Inventors: Benno Frank Smit; Brent Richard Mooney; Christopher Arthur Good; Andre Brian Aish, all of Auckland (NZ)

(73) Assignee: Fisher & Paykel Limited, Auckland (NZ)

( * ) Notice: Subject to any disclaimer, the term of this patent is extended or adjusted under 35 U.S.C. 154(b) by 0 days.

(21) Appl. No.: 09/594,928

(22) Filed: Jun. 15, 2000

(30) Foreign Application Priority Data

Jun. 15, 1999 (NZ) ..... 336291

(51) Int. Cl.[7] ..... D21J 3/00

(52) U.S. Cl. ..... 162/382; 162/383; 162/390; 162/396; 162/409; 162/410; 162/411; 425/85; 425/84; 425/271; 422/169; 422/327; 521/55; 264/86; 264/87

(58) Field of Search ..... 162/382, 383, 162/390, 396, 409, 410, 411, 218, 224, 226, 227; 425/85, 84, 271; 422/169, 327; 521/55; 264/86, 87

(56) References Cited

U.S. PATENT DOCUMENTS

| | | | | |
|---|---|---|---|---|
| 2,986,211 A | | 5/1961 | Hartmann et al. | |
| 3,064,727 A | | 11/1962 | Hartmann et al. | |
| 3,166,468 A | | 1/1965 | Daniele et al. | |
| 3,477,908 A | | 11/1969 | Daniele | |
| 3,661,707 A | | 5/1972 | Emery et al. | |
| 3,922,191 A | | 11/1975 | Witt et al. | |
| 4,448,640 A | | 5/1984 | Brault et al. | |
| 5,174,863 A | | 12/1992 | Emery | |
| 5,656,135 A | * | 8/1997 | Baker | 162/388 |

FOREIGN PATENT DOCUMENTS

| | | |
|---|---|---|
| EP | 0559490 | 9/1993 |
| GB | 2295350 | 5/1996 |
| NZ | 211084 | 11/1986 |
| NZ | 238457 | 10/1994 |
| WO | WO 9419540 | 9/1994 |
| WO | WO 9922069 | 5/1999 |

* cited by examiner

*Primary Examiner*—Stanley S. Silverman
(74) *Attorney, Agent, or Firm*—Trexler, Bushnell, Giangiorgi, Blackstone & Marr, Ltd.

(57) ABSTRACT

A pulp forming machine includes a forming head including a platen and plurality of mould carriers. The mould carriers are connected to the platen by mould carrier support means which allow the mould carrier and the platen to transmit forces perpendicular to the general plane of the platen but allow movement and expansion of each mould carrier in the general plane of the platen. Mould carrier to mould carrier locating means locate the mould carriers of opposing platens during the forming process to align moulds carried on the mould carriers with cooperating moulds of the cooperating platen.

19 Claims, 7 Drawing Sheets

PULP FORMING MACHINES

BACKGROUND TO THE INVENTION i) Field of the Invention

The present invention relates to pulp forming machines.

ii) Summary of the Prior Art

In the prior art pulp forming machines are known in which a pulp slurry is sucked onto a porous forming mould to provide initial forming of a moulded pulp product. This product is subsequently pressed between two heated mould halves to dewater the product.

For production efficiencies machines are preferred to have more than one product item being formed simultaneously. To achieve this the forming platens are provided with an array of fixed mould halves. In prior art pulp forming machines the fixed mould halves present difficulties of accurate cooperation with fixed mould halves of other platens with which they are to cooperate due to often significant temperature differences at different stages in the forming process. The temperature differential leads to misalignment of mould halves which were intended to cooperate when platens are brought together

SUMMARY OF THE INVENTION

It is an object of the present invention to provide a pulp forming machine and/or parts thereof which will at least go some way to overcoming the above disadvantages and/or which will at least provide industry with a useful choice.

In a first aspect the invention consists in a pulp forming machine including a forming head comprising;

a platen, a plurality of mould carriers, mould carrier support means connecting each said mould carrier to said platen and allowing said mould carrier and said platen to transmit forces perpendicular to the general plane of said platen, but to allow movement and expansion of each said mould carrier in the general plane of said platen, and mould carrier to mould carrier locating means to locate the mould carriers during a forming process to align moulds carried thereon with co-operating moulds of a co-operating platen.

In a further aspect the invention consists in a pulp forming machine including a forming head comprising:

a platen, a plurality of mould carriers, each said mould carrier including one or more connection posts protruding from the back face thereof and passing within the body of said platen, each said post including a mould carrier facing engagement surface, and laterally movable post engagement means in said body of said platen, having a securing face facing away from the respective said mould carrier, lateral movement of said post engaging means effecting change of said assembly between a first condition wherein said securing surface of said post engagement means and said engagement surface of said post bear against one another and said mould carrier is supported against movement away from said platen, and a second condition wherein said post engagement means is not engaged with said posts and said posts may be withdrawn from within said platen.

In a still further aspect the invention consists in a pulp forming station including an upper mould carrying platen, a lower mould carrying platen, platen movement means connected to one of said upper and lower mould carrying platens for bringing said platens together, and clamping means for pressing said platens together including a plurality of clamping engagements on one said mould platen and a plurality of actuating means on the other said mould platen for drawing against said clamping engagements in use.

In a still further aspect the invention consists in a pulp forming machine including one or more forming stations and one or more mobile platens supported from above, said mobile platens supported substantially centrally from and movable along the line of an elevated beam running the length of said machine.

In a yet further aspect the invention consists in a pulp forming machine incorporating one or more of the inventions set forth in the above paragraphs.

In a yet further aspect the invention consists in a method of demoulding platens of a pulp forming machine comprising the steps of:

bringing an upper and a lower mould platen incorporating complementary mould halves together, linking corresponding pairs of moulds and/or mould carriers associated with each said platen together, releasing the lower said set of mould carriers and/or moulds from engagement with said lower platen, moving apart said upper and lower mould platens, moving laterally said upper mould platen to a detooling station, introducing a mould and/or mould carrier support below said upper platen at said detooling station, releasing said upper mould carriers and/or moulds from said upper platen, and vertically separating said upper platen from said mould support.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

DETAILED DESCRIPTION OF A PREFERRED EMBODIMENT

Figure 1:
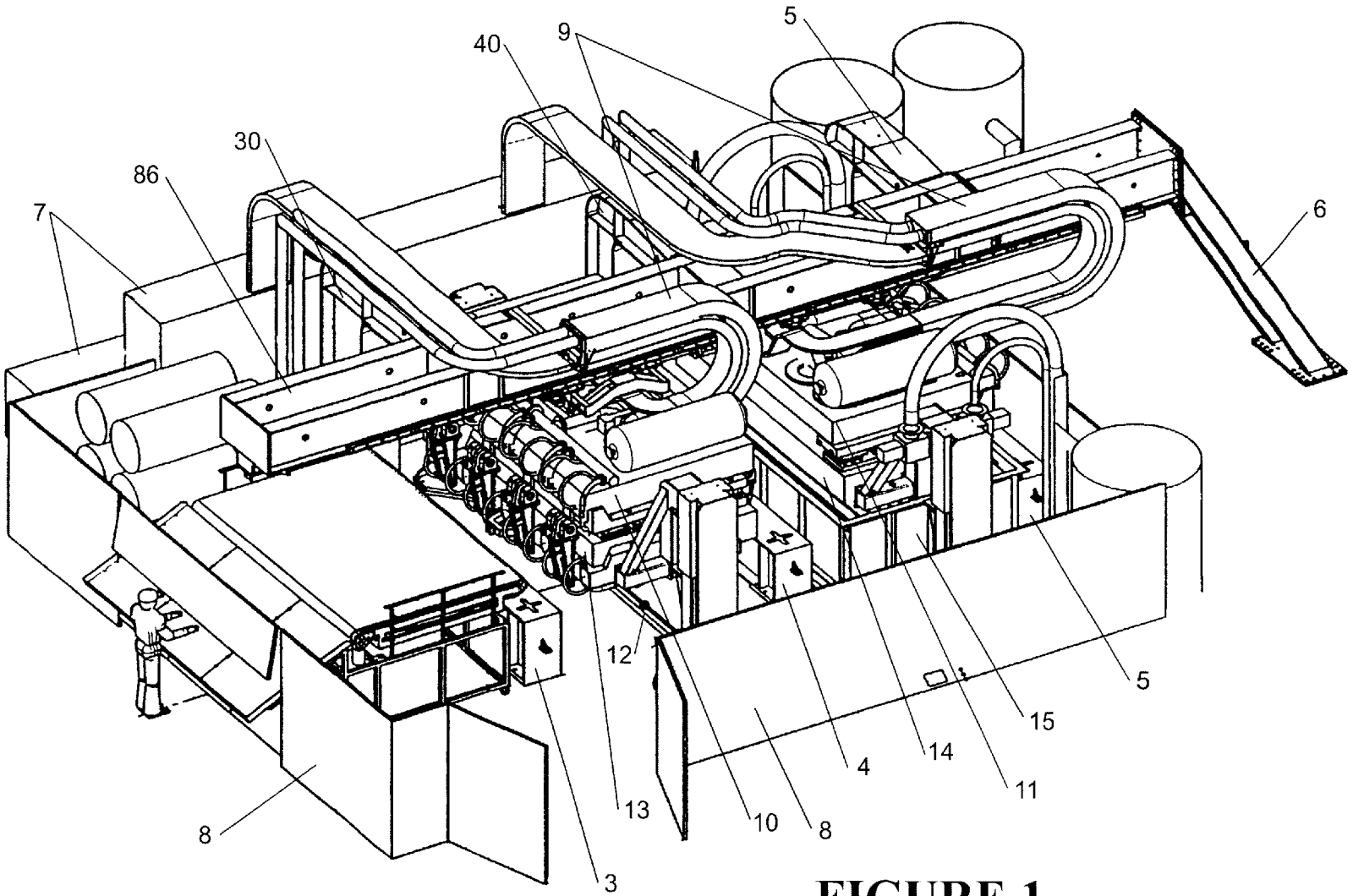
FIG. 1 is a perspective view of the complete pulp forming machine according to the present invention.

The pulp forming machine of the present invention shown in FIG. 1 is designed for the production of high volume, quality surface finish packages and containers from recycled waste paper.

The Process

Waste paper is processed into a liquid pulp furnish, pumped into and circulated around a holding tank 15. Mesh tooling, formed to the profile of the finished component, is passed through the pulp, forcing the furnish fibres to adhere to the mesh. This process is assisted by the application of vacuum suction from the back of the tool. When sufficient thickness of pulp is layered onto the tool, it is raised out of the furnish, the vacuum continues drawing the pulp matting onto the tool and considerably reducing the moisture content.

For the second part of the operation whilst suction continues, a heated aluminium tool with a profile machined to match that of the wire mesh tool, contacts the now forming product. The result of heat, moderate pressure and vacuum now being used on both sides, causes the pulp fibres to bind together and form a product to the shape of the moulding tools.

The formed item is now able to be transferred to a second set of heated aluminium tooling which is accurately machined to precisely the shape of the final product. This mould clamps together with another heated mould tool. Again heat and vacuum are continually operating, however in this stage greater forces are applied to clamp the tools resulting in a high finish to the final product.

The Machine

The backbone of the machine is a monorail cantilevered beam 86 which is, for example, approximately eighteen meters long.

A "C" frame 30, 40, 5 construction allows ease of access around the working part of the machine. Three of these fabricated "C" frames support the main beam and hold it parallel to the ground at a height of, for example, four meters.

One end of the beam (the end opposite the unloading end) is attached to an angled support 6 which like the "C" frames is bolted onto the required foundations, giving excellent stability to the whole construction.

The machine is laid out for economy and efficiency with control cabinets and plant 7 (such as the hydraulics and vacuum equipment) just outside of or integral to the safety fencing 8. Cables and pipeworks are routed up the "C" frames and via heavy duty cable carriers 9 to the two upper moving platens 10, 11 and through trunking 12 along the ground to the two vertical lift lower platens 13, 14.

Figure 2:
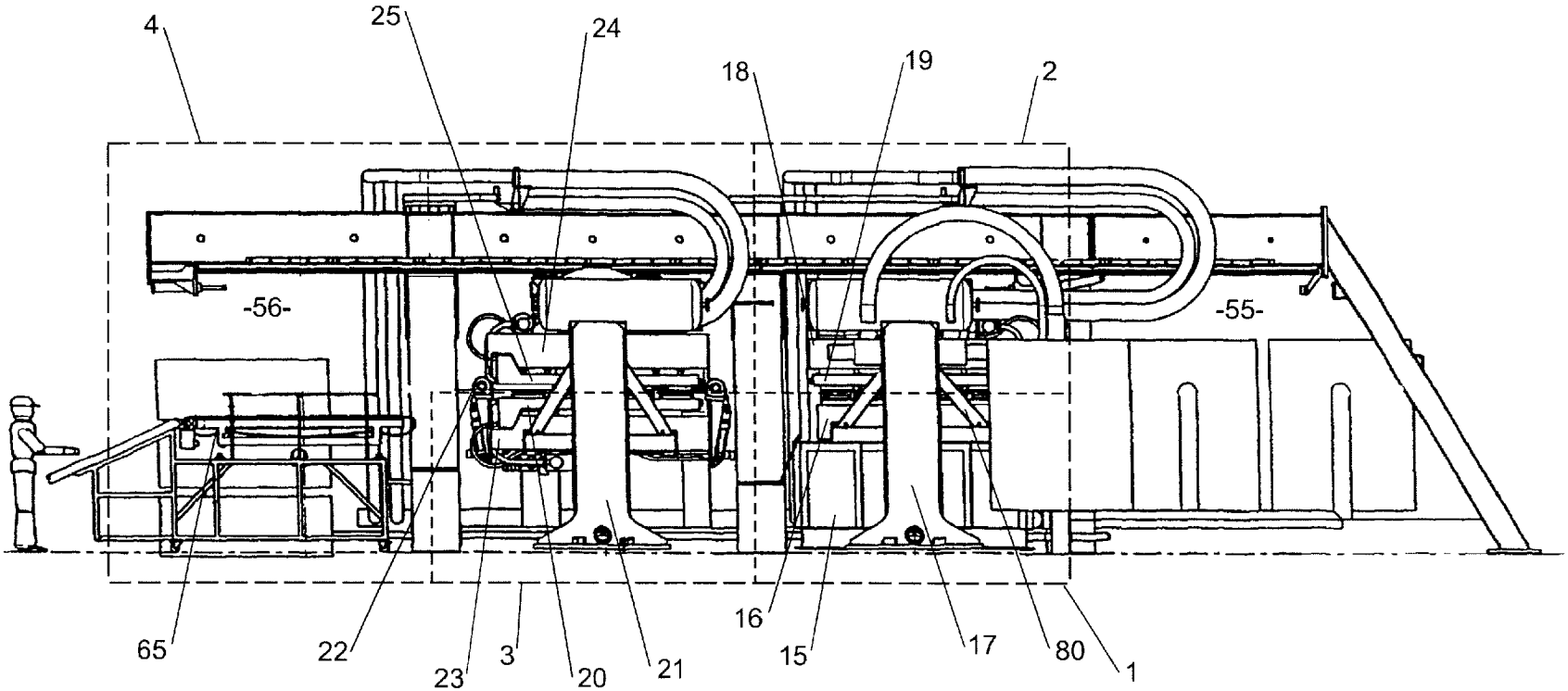
FIG. 2 is a side elevation of the forming machine of FIG. 1 (with safety barriers not showing).
Figure 3:
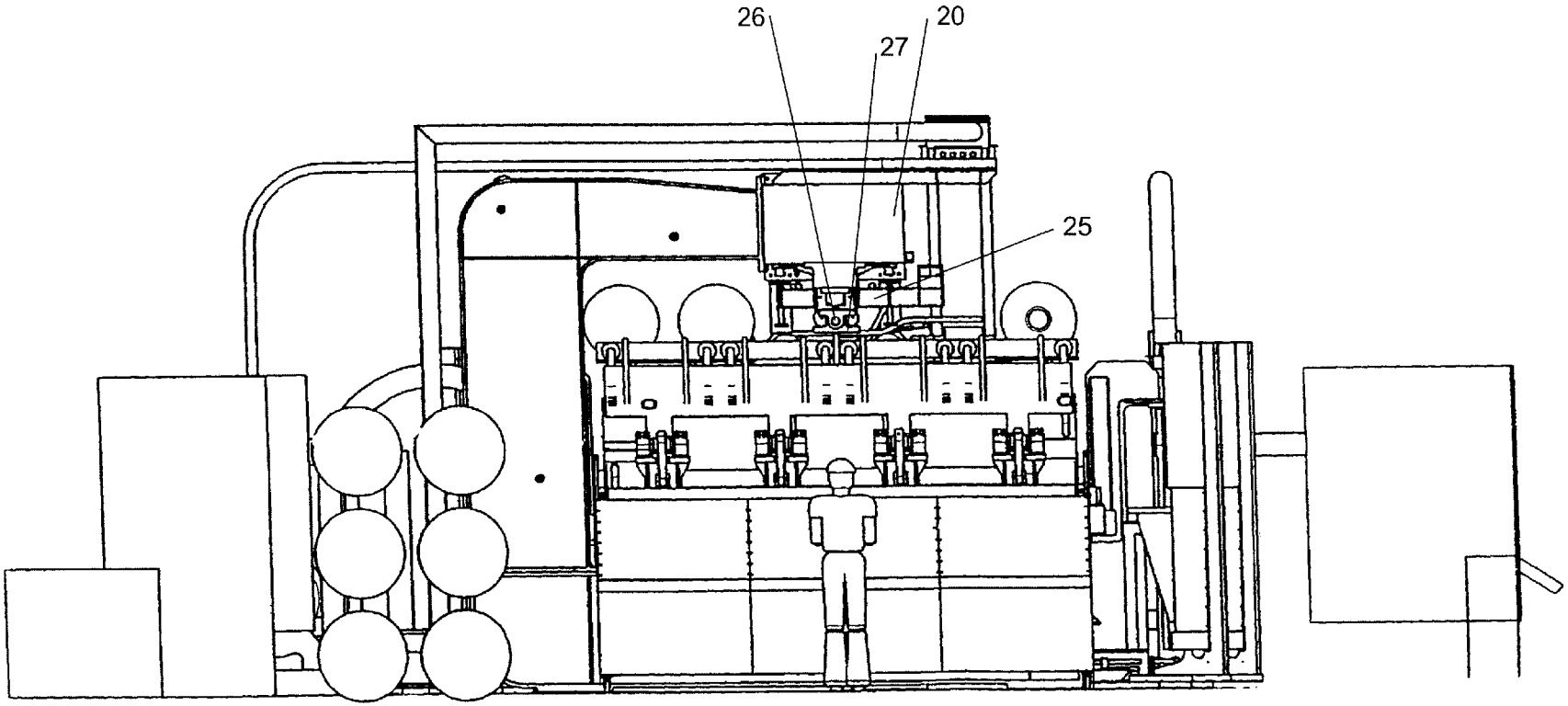
FIG. 3 is an end elevation of the forming machine of FIG. 1 (again with safety barriers not showing).

Operationally, the machinery consists of four main sections which are sequentially active in forming each product. The details and function of these is described later, these will be referred to as sections 1 to 4 and their regions in the machine are indicated by broken line enclosed areas in FIG. 2.

Section 1 includes:

pulp holding tank 15 strainer frame 16 (which may be generally referred to as head 1)

stainer frame lift 17

Wire mesh tool carrier pulp exclusion wash

Section 2 includes:

pulp station upper platen 18 (which may be generally referred to as head 2)

mould carriers quick release

Section 3 includes:

forming station lower platen 20 (which may be generally referred to as head 3)

forming station lift 21 clamps 22 mould carriers 23

Section 4 includes:

forming station upper platen 24 (which may be generally referred to as head 4)

mould carriers 25 outfeed

Section 1 of the Machine

In the operation of section 1 mesh tooling attached to the main strainer frame 16 is submerged into the tank 15 containing pulp solution. Vacuum is applied as it moves out of the fluid and is moved into contact with the upper mould tools.

The Pulp Tank

A pulp holding tank 15 manufactured from non-corrosive material is located between the first pair of "C" frames 5,4. A control system constantly monitors the level of pulp within the tank and pulp is supplied on demand from the main pulp holding tank to ensure it remains at a constant level. In order to keep the pulp mixture evenly distributed, the fluid is continuously moved by an auxiliary pump and circulation system.

The Strainer Frame

Manufactured from stainless steel with dimensions of for example 4000 mm×2200 mm, the strainer frame 16 is mounted onto a vertical lift 17 at each end. It acts as platform for a set of mould carriers and wire mesh tooling which together are secured to its top surface. Alternatively in the strainer frame the mould may be secured in a mould mounting chamber on the strainer frame 16 rather than via a set of mould carriers.

In the embodiment depicted eight carriers, each capable of holding five wire mesh tools, are able to be fitted with frame dimensions as suggested above with the tools sized to make a product of up to 310 mm×310 mm. Depth of product and draft angle can be varied considerably with the machine. A vacuum manifold is built into the fabricated frame 17 with connections to the mould carriers at bottom centre on one side and through the lift arm and flexible piping to a vacuum reservoir on the other.

The Vertical Lift

Floor mounted at either end of the pulp tank 15 are two lifting mechanisms 17 connected to the strainer frame 16 through an overhanging lift arm 80.

The arm 80 is in turn attached to a carriage which travels vertically on linear bearings and tracks. In order to keep the strainer frame raising and lowering evenly, the carriages are powered by hydraulic servo cylinders with integrated encoding systems. Constant feedback allows the frame to quickly move to various levels and ensures that the final contact position with the upper tooling may be accurate and alignment may be maintained.

The Wire Mesh Tool Carriers

Simple fabricated aluminium boxes (for example 2100 mm×440 mm×100 mm thick) with an open top face and covered bottom, each have five wire mesh tools screwed onto the top face, effectively creating a sealed chamber. The carriers are locked onto the strainer frame 16 utilising a quick release mechanism similar to that described later for the hot mould carriers.

When a carrier is located in position, a hole in the base plate is aligned with the vacuum manifold tube in the strainer fame, an "O" ring seal around this area allows vacuum to be applied to each individual carrier. Should the single mesh tool be removed for maintenance, a blanking plate is preferably fitted in its place. Along with the mesh tooling, the upper surface includes heel block guides that mate with a cooperating guide on the upper carrier. As the upper carriers float, the bringing together of the heel guides ensures that the tools are accurately in fine in two directions in the horizontal plane when pressed together.

The Pulp Exclusion Wash

Removal of residual material from the tooling after each cycle is achieved by a variable high and low pressure washing system using nozzles to direct the waterjet at a specific part of the tool.

Section 2 of the Machine

The Pulp Station Upper Platen

The upper platens 18, 24 are substantially identical steel fabrications, travelling along the main beam 20 on trackways and linear bearings which are attached to a yoke 25 that is in turn fixed to the platen by a pivot shaft 26 and bearing 27. Movement of the heads is provided by electric servo motors driving through a rack and pinion system.

Special attention is given in the invention to the control of thermal expansion to ensure tooling alignment.

The use of a number (in the present example eight) mould carriers insulated from the platen greatly reduces the heat seen by the platens. However, some expansion of the platens is still anticipated. In the invention the effect of this expansion is controlled by centrally mounting the connecting point of the platens, thus ensuring that expansion is outwards from the centre of the platen. The lower forming platen is also centrally located keeping its mould carrier in alignment.

Heeling on the carriers ensures final precision location when tools come into contact.

The Mould Carriers

With particular reference to FIGS. 5 to 8, as previously stated, the mould carriers are mounted on each head 2, 3 and 4. To improve on the primary concerns of insulation, alignment and quick tooling exchange a number of unique features are present in the design.

The carrier is preferably manufactured from a solid aluminium block (for example 2000 mm×450 mm×100 mm), the bottom face of which has machined grooves into which tubular heating elements are fitted. These are covered by a steel retaining plate.

Holes for the vacuum are machined through the centre of the block along its length from the top surface smaller holes into the main porting. These link up with the holes in the back of the tooling 32.

The mould carriers are supported on their rear mounting face 31 by a number of button support assemblies 33 and are loosely located into position by two locating pins 36 running in clearance slots 37. The button support assemblies incorporate a thermal resistive pad 38 mounted on top of a spring 39. The locating pins 36 extend past the clearance holes 37 and have a lock plate 40 inserted through, the lock plate 40 being part of the quick release mechanism as described later.

This support method gives the following advantages:

- the hot mould carriers are thermally insulated from the platens, reducing heat loss from the process and thermal expansion of the platens.
- by suspending the mould carrier on springs (the button support assemblies) along its length, deflection along the mould carrier is minimised leading to an even thickness of product between the moulds on each carrier.
- the floated positioning allows the mould carrier to confirm to the mating tooling ensuring tool alignment.
- the main part 38 of the support button 33 itself is manufactured from material with low thermal conductivity isolating the carrier from the platen and minimising the losses providing more economical heating.
- compliance is gained by clamping the insulating buttons to the platen on a set of preloaded disc springs.

Should one set of tooling come into contact ahead of the rest (possibly due to too much pulp being present), its carrier will collapse the springs avoiding high point loading and allowing the other 35 tools to still produce a good product.

The Quick Release

It is seen as desirable to the operation of high heat machines that the time required to remove and replace hot tooling safety is minimised.

In the present invention no bolting is needed, avoiding the necessity of operators to use hand tools close to the heat source. Instead, a pull-down system is employed, utilising the location pins in the back of the mould carriers.

Both pins have a vertically slotted horizontal hole 41 machined therethrough When the carrier is offered up to the platen, these slots extend into a cavity 42.

Guided locking plates having a cambered leading edge and being remotely actuated from outside the platen, are driven into the slot 41, pulling the mould carrier 31 up onto the platen. At the point of clamping, where the springs of the support buttons have become slightly depressed, the hold down face of the locking plate becomes parallel to the plane of the platen allowing for movement of the carrier in relation to the platen.

Mould carrier removal also takes place with the minimum of operator involvement. Before the carriers are unclamped, the lower platen 16 or 20 is raised until the tooling is in the unloading position. Both upper and lower heel blocks (eg 46, 47 FIG. 4) have clearance holes 48, 49 that align when the tooling is in the unload position, and a joining rod 50 is passed through these holes and effectively ties the upper and lower carriers together.

The mould carrier clamp mechanism on the bottom mould carrier is operated for example through a threaded rod 52 engaged in a threaded hole in a bar 53 carrying the locking plates 40. Rotation of the threaded rod 52 leads to linear actuation of the locking plates 40. With the external end 54 of the threaded rod provided with a suitable socket or engagement, movement of the locking plates can be effected using a battery drill/driver with appropriate attachment (or similar tool).

The bottom platen 16 or 20 can now lower leaving the lower mould carriers behind. When clear, the top platen 18 or 24 moves to the maintenance unload station (55, 56) and a support is placed under the suspended carriers. The upper platen lock mechanism, which is preferably the same in form and operation as the lower platen lock mechanism, can now be released.

Section 3 of the Machine

The Forming Station Lower Platen

Figure 4:
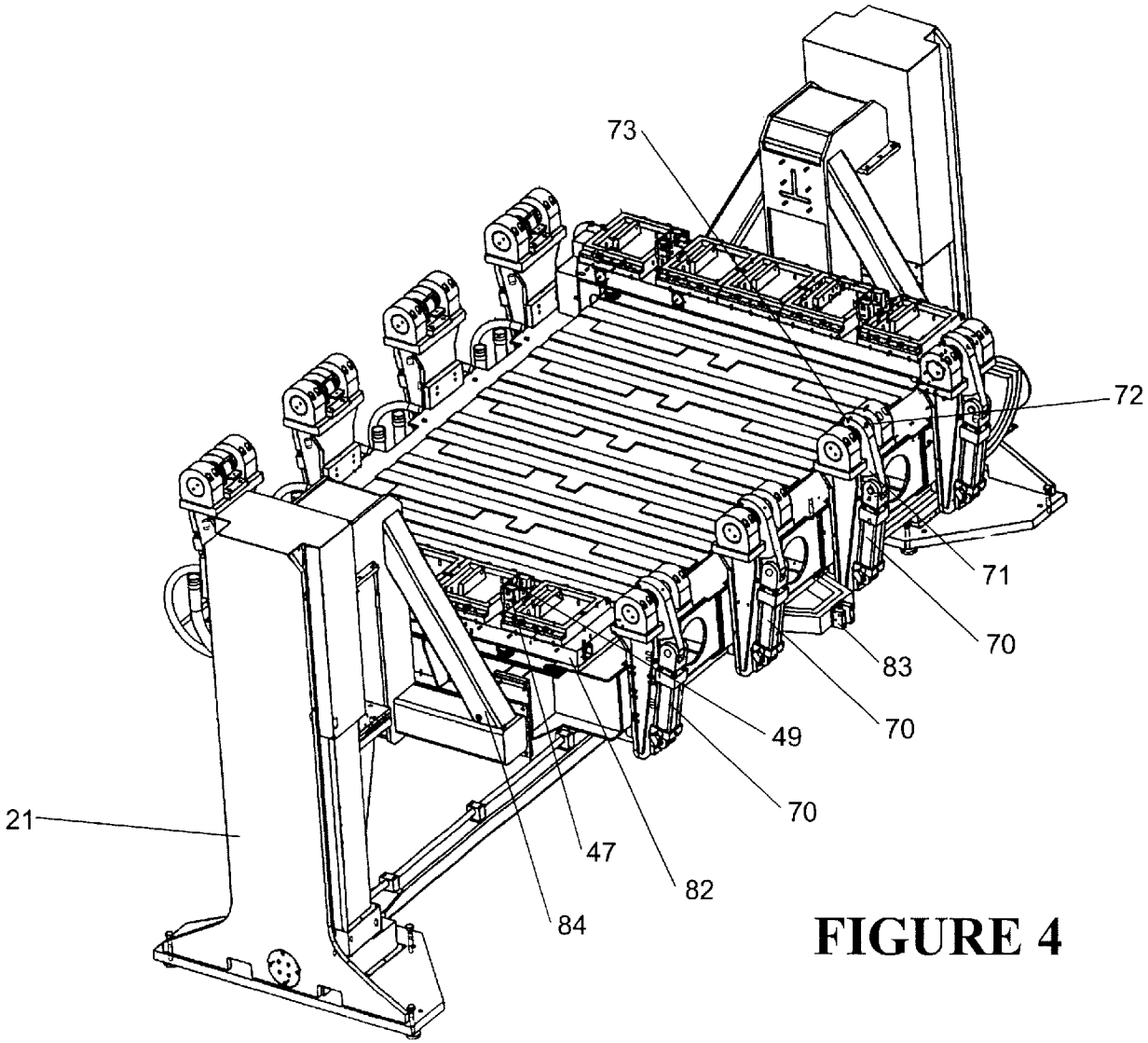
FIG. 4 is a perspective view of a lower forming head assembly of the forming machine of FIG. 1.
Figure 5:
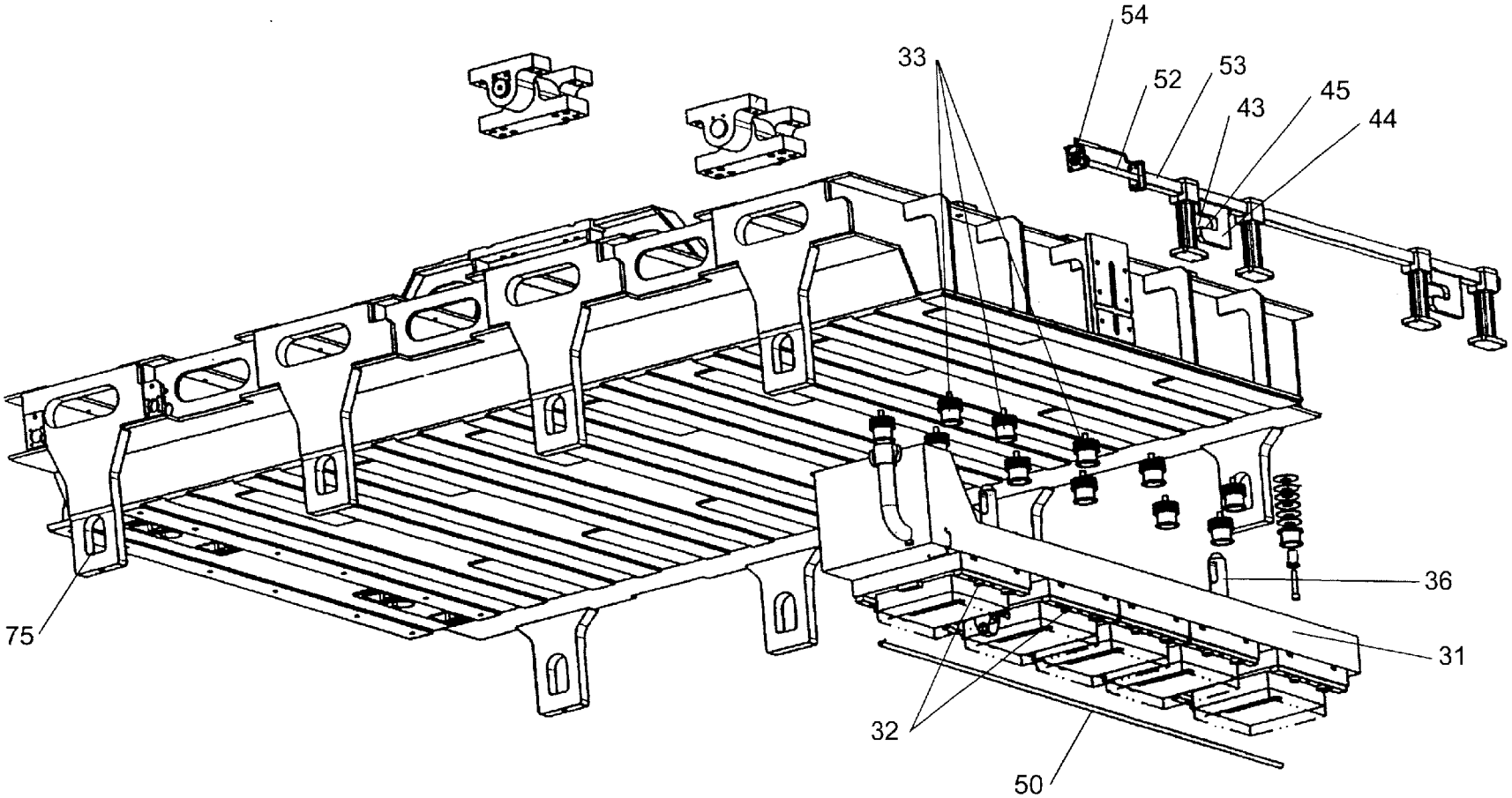
FIG. 5 is a perspective exploded view of an upper platen and mould carrier assembly according to the forming machine of FIG. 1.
Figure 6:
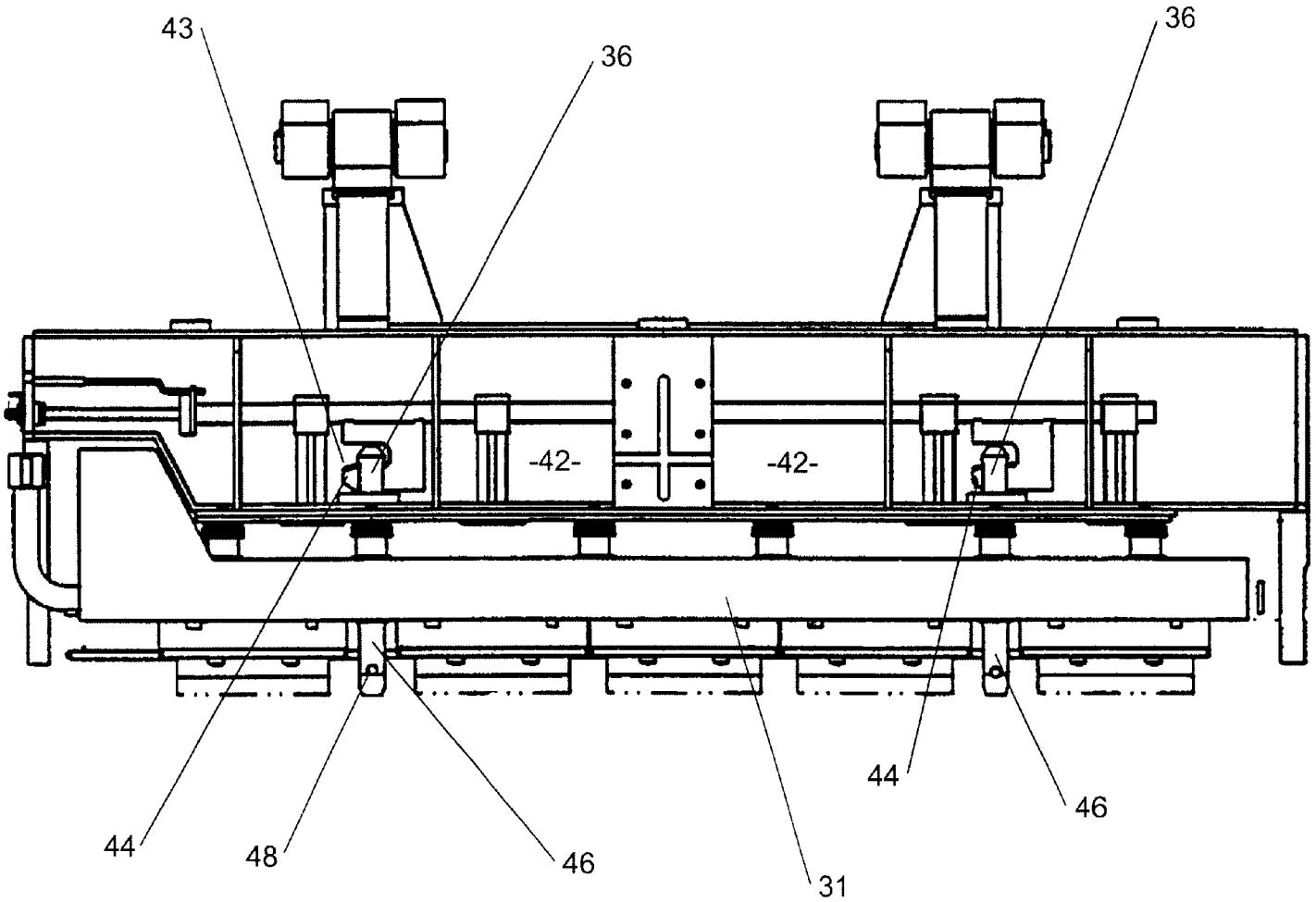
FIG. 6 is a side elevation of the platen and mould carrier assembly of FIG. 5 (unexploded).
Figure 7:
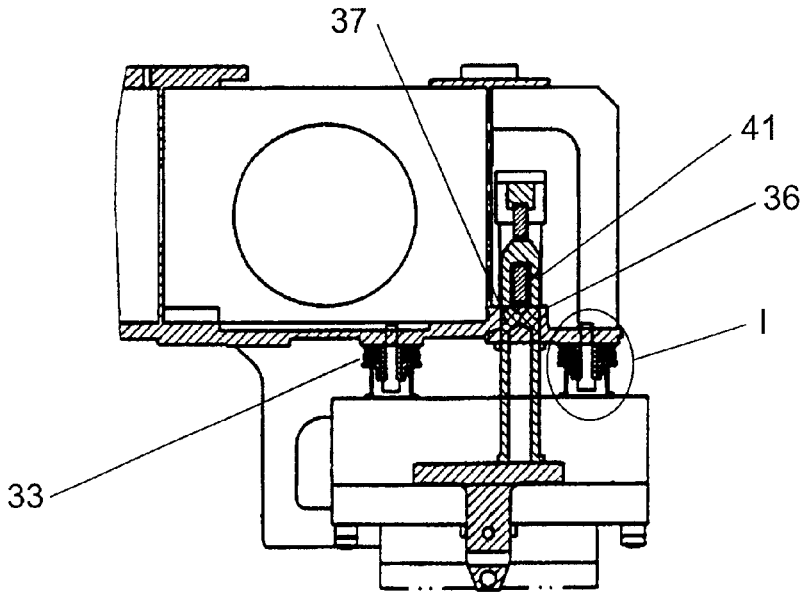
FIG. 7 is a partial end elevation in cross section depicting the connection of the mould carrier and platen of FIG. 5.
Figure 8:
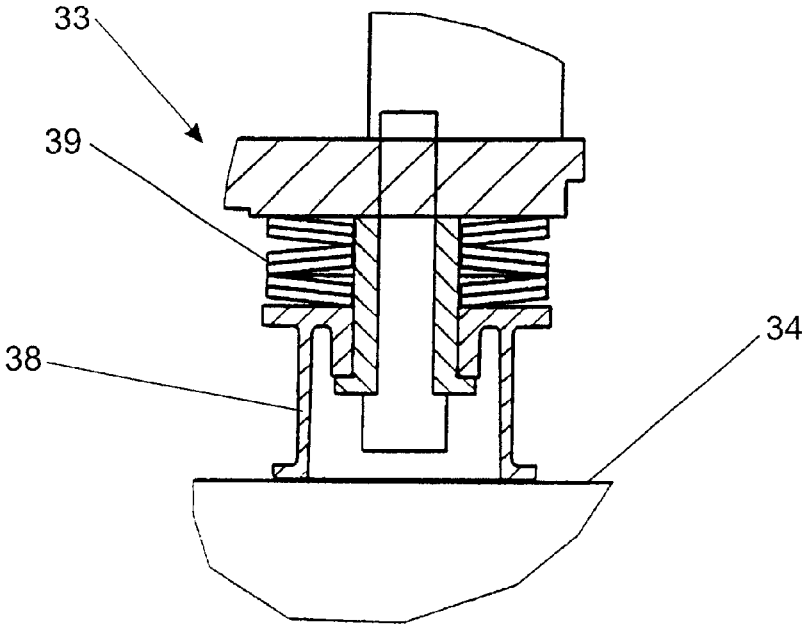
FIG. 8 is an expanded view of the region I of FIG. 7.

With reference to FIG. 4 the lower forming station platen 20 is a similar steel fabrication to the upper platens. It is supported at the ends by two lift units 21. Mould carriers 82 are mounted on the platen in the same way as on the other platens. However unlike the upper platens this platen is not supported at its centre. The weight of the platen is supported by a pair of lift units, which are preferably interchangeable with the lift units 21 of the pulp station. Thermal expansion on this lower forming platen is controlled about the centre of the platen by a guiding system fixed in centre of the platens on either edge. The guiding system may comprise a vertical track adjacent either edge guiding respective sliding shoes 83 carried by the platen.

To co-operate with the central guiding system and the outward expansion that is its result a laterally sliding joint is provided between each lift arm 84 and the platen.

To remove the prior art need for massive supporting construction, a clamping system is provided that keeps all forces internal to the upper and lower forming platens when pressing the platens together. Upper forming head 4 carried on the beam 86 is moved into position above the lower forming head which is raised by its servo drive system into partial contact with the upper head.

A series of hydraulic cylinders 70 mounted along each side of platen 20 when actuated rotate a link arm 71 about a pivot 72 connected to the lower platen. A bearing face 73 at the opposite end of the link arm engages a wear pad 75 (see FIG. 5) on the upper platen, pulling the platens together. The resulting clamping force preferably exceeds 100 tonnes.

Section 4 of the Machine

The Forming Station Upper Platen

This is preferably the same as the pulp station upper platen 18 although the carried moulds are formed with an accurate surface finish, as the forming station mould platens perform the final forming step in producing a product. Connection of the moulds via mould carriers, and the connection of the mould carriers is preferably in accordance with the other platens.

Outfeed

The outfeed table is a conveyer mounted on ball screw jacks driven from a common electric motor. As head 24 moves into the unload position, the conveyer raises and the products are ejected from the tooling. The conveyor lowers clear and on the next cycle raises to a height one stack thickness lower than the previous position. Once a number of sets of products are stacked this way, completed products are conveyed to the outfeed for collection by an operator.

What is claimed is:

1. A pulp forming machine including a forming head comprising;

a platen having a,general plane, a plurality of mould carriers, mould carrier support means connecting each said mould carrier to said platen and allowing said mould carrier and said platen to transmit forces perpendicular to the general plane of said platen, while allowing movement and expansion of each said mould carrier in the general plane of said platen, and mould carrier to mould carrier locating means to locate the mould carriers during a forming process to align moulds carried thereon with moulds of a co-operating platen.

2. A pulp forming machine as claimed in claim 1 wherein said mould carrier support means provides a thermally insulative connection between said mould carriers and said platen.

3. A pulp forming machine as claimed in claim 1 wherein said support means includes a plurality of elastic support buttons distributed over the area of said mould platen.

4. A pulp forming machine as claimed in claim 3 wherein each said mould carrier carries a row of moulds and said platen carries a plurality of side by side mould carriers to thereby carry an array of moulds, and each said mould carrier is independently supported.

5. A pulp forming machine as claimed in claim 4 wherein said elastic support buttons of said support means are connected to the lower face of said platen, and each have a downwardly facing bearing surface bearing against a sliding surface on the upper face of a respective said mould carrier.

6. A pulp forming machine including a forming head comprising:

a platen, a plurality of mould carriers, each said mould carrier including one or more connection posts protruding from the back face thereof and passing within the body of said platen, each said post including a mould carrier facing engagement surface, and laterally movable post engagement means in said body of said platen, having a securing face facing away from the respective said mould carrier, lateral movement of said post engaging means causing change of said assembly between a first condition wherein said securing surface of said post engagement means and said engagement surface of said post bear against one another and said mould carrier is supported against movement away from said platen, and a second condition wherein said post engagement means is not engaged with said posts and said posts may be withdrawn from within said platen.

7. A pulp forming machine as claimed in claim 6 wherein said securing surfaces of said post engagement means include a final position securing surface parallel to the direction of movement of said post engagement means and a draw-in surface at an angle to said final surface, such that on lateral movement of said post engagement means from said second condition to said first condition said engagement surface of said post initially contacts said angled surface and slides there along with the movement of said post engagement means, and with continued sliding movement of said post engagement means is brought to be in contact against said final securing surface, such that in sliding movement along said angled surface said mould carrier is drawn towards said platen.

8. A pulp forming machine as claimed in claim 6 wherein said forming head includes a plurality of elastic support buttons between said platen and each said mould carrier and distributed over the area between the respective said mould carrier and said mould platen, said support buttons including a degree of compression with said carrier in said first condition.

9. A pulp forming machine as claimed in claim 6 wherein each said mould carrier includes mould carrier interengagement means which allow said mould carrier to be interengaged, with a corresponding mould carrier of a further said forming head.

10. A pulp forming machine as claimed in claim 6 wherein said posts of said mould carrier have lateral freedom of movement relative to said platen and said post engagement means.

11. A pulp forming station including an upper mould carrying platen, a lower mould carrying platen, platen movement means connected to one of said upper and lower mould carrying platens for bringing said platens together, and clamping means for pressing said platens together including a plurality of clamping engagements on one said mould platen and a plurality of actuating means on the other said mould platen for drawing against said clamping engagements in use.

12. A pulp forming station as claimed in claim 11 wherein said clamping engagements each comprise a bearing surface facing away from the other said mould platen.

13. A pulp forming station as claimed in claim 11 wherein each said clamping actuator comprises a centrally supported clamp member rotatable about said central support located peripherally on said mould platen, and having an engagement surface at one end thereof, and a linear actuator connecting between the other said end of said clamp member and a fixed actuator support position on said mould platen, such that extension and contraction of said linear actuator will cause rotation of said member about said pivotal support.

14. A pulp forming station as claimed in claim 11 wherein said clamping means includes a series of said engagements spaced along each of two opposed sides of said mould platens.

15. A pulp forming station as claimed in claim 11 wherein said mould platen movement means support said lower mould platen and are connected with a pair of opposed sides of said platen not being a pair of opposed sides including said clamping means.

16. A pulp forming machine including one or more forming stations, an elevated central beam passing over said forming stations, at least one mobile platen, and a carriage connection between each said mobile platen and said beam, supporting the platen from said beam with the beam passing over the center of the platen and allowing movement of the platen along the length of said beam.

17. A pulp forming machine as claimed in claim 16 wherein said elevated beam is supported by cantilever supports extending substantially perpendicularly to the line of said beam on one side thereof, and includes no such said supports on the other side thereof.

18. A pulp forming machine as claimed in claim 17 wherein said beam includes a further support extending to the foundation surface from one end of said beam.

19. A pulp forming machine as claimed in claim 16 wherein said cantilevered supports are one or more substantially C shaped frames wherein the upper lateral arm of said C shape connects at its end to said elevated beam, the vertical of said C shape is located outside the periphery and movement envelope of said platens, and the lower lateral arm of said C shape extends across said foundation surface at least to a point vertically below the centre line of said elevated beam.

* * * * *